US012479688B2

(12) United States Patent
Zhang et al.

(10) Patent No.: US 12,479,688 B2
(45) Date of Patent: Nov. 25, 2025

(54) RIGID-FLEXIBLE COUPLING MECHANISM WITH VARIABLE ROD LENGTH FOR FIBRE BUNDLE TENSION CONTROL

(71) Applicant: BEIHANG UNIVERSITY, Beijing (CN)

(72) Inventors: Wuxiang Zhang, Beijing (CN); Minghui Yi, Beijing (CN); Xilun Ding, Beijing (CN); Yixin Shao, Beijing (CN); Huichao Deng, Beijing (CN)

(73) Assignee: BEIHANG UNIVERSITY, Beijing (CN)

( * ) Notice: Subject to any disclaimer, the term of this patent is extended or adjusted under 35 U.S.C. 154(b) by 279 days.

(21) Appl. No.: 18/224,142

(22) Filed: Jul. 20, 2023

(65) Prior Publication Data

US 2023/0365375 A1 Nov. 16, 2023

Related U.S. Application Data

(63) Continuation of application No. PCT/CN2021/075768, filed on Feb. 7, 2021.

(30) Foreign Application Priority Data

Jan. 22, 2021 (CN) ..... 202110088240.1

(51) Int. Cl.
*B65H 59/36* (2006.01)
*B65H 59/10* (2006.01)
(Continued)

(52) U.S. Cl.
CPC ..... *B65H 59/36* (2013.01); *B65H 59/10* (2013.01); *B65H 59/12* (2013.01); *B65H 59/14* (2013.01);
(Continued)

(58) Field of Classification Search
CPC ..... B65H 59/00; B65H 59/12; B65H 59/14; B65H 59/36; B65H 59/08; B65H 59/10;
(Continued)

(56) References Cited

U.S. PATENT DOCUMENTS 3,326,436 A * 6/1967 Huck ..... B41F 13/025 226/25
3,384,281 A * 5/1968 Mason ..... H04L 13/06 226/25
(Continued)

FOREIGN PATENT DOCUMENTS

CN 108589006 A 9/2018
CN 108792786 A 11/2018
(Continued)

OTHER PUBLICATIONS

CN209065198U Translation; Mao et al; "A Tow Tension Adjusting Device For Chemical Fibre Production"; Published on: Jul. 5, 2019 (Year: 2019).*
(Continued)

*Primary Examiner* — Anna M Momper
*Assistant Examiner* — Raveen J Dias
(74) *Attorney, Agent, or Firm* — Troutman Pepper Locke LLP; Tim Tingkang Xia, Esq.

(57) ABSTRACT

The invention discloses a rigid-flexible coupling mechanism with variable rod length for fibre bundle tension control. In the transmitting process, the fibre bundle passes through the front guide roller, the tension regulating roller and the back guide roller sequentially. The front and back guide rollers have fixed positions, while the tension regulating roller has an adjustable position to regulate the fibre bundle tension. The invention uses the variable rod length rigid-flexible coupling mechanism with a combination of a servo motor and an electric actuator in a dual drive control mode, which
(Continued)

can choose to use either a four-rod fixed length mechanism or a five-rod variable length mechanism to regulate the tension under different working conditions. This provides a more flexible control method, increases the regulating range of fibre bundle tension, improves the system response speed and regulation accuracy, and effectively avoids the wear of fibre bundle caused by tension fluctuations.

2 Claims, 2 Drawing Sheets

(51) Int. Cl.
*B65H 59/12* (2006.01)
*B65H 59/14* (2006.01)

(52) U.S. Cl.
CPC .... *B65H 2701/174* (2013.01); *B65H 2701/30* (2013.01); *B65H 2701/31* (2013.01)

(58) Field of Classification Search
CPC .. B65H 59/381; B65H 59/382; B65H 59/384; B65H 2701/174; B65H 2701/30; B65H 2701/31; B65H 2701/312; B65H 2701/313; B65H 2701/314; B65H 2701/319; B65H 23/048; B65H 23/16; B65H 57/00; B65H 57/14
USPC ..... 242/419.7
See application file for complete search history.

(56) References Cited

U.S. PATENT DOCUMENTS 3,556,369 A * 1/1971 Ferguson ..... B65H 59/10 226/25
3,556,373 A * 1/1971 Whitney ..... B65H 59/36 226/117
3,667,664 A * 6/1972 Schroeder ..... B65H 59/00 226/111
3,680,753 A * 8/1972 Shaw-Stewart ..... B65H 59/384 226/25
3,808,789 A * 5/1974 Hurley ..... B65H 59/38 226/25
3,822,832 A * 7/1974 Torii ..... B65H 59/38 242/413.5
4,010,915 A * 3/1977 Strutz ..... B65H 59/10 28/186
4,359,178 A * 11/1982 Hayashi ..... B65H 23/1888 226/25
4,782,648 A * 11/1988 Van Ottele ..... B65B 13/02 53/553
4,854,511 A * 8/1989 Montali ..... B65H 59/38 242/417
5,139,206 A * 8/1992 Butler ..... B65H 59/36 242/420.6
5,176,334 A * 1/1993 Dreschau ..... B65H 23/16 242/413.3
5,738,295 A * 4/1998 Flamm ..... B65H 59/30 242/419.1
5,791,584 A * 8/1998 Kuroiwa ..... B65H 59/40 242/417.3
5,826,774 A * 10/1998 Dell'Aglio ..... H02K 15/09 242/419.1
6,237,383 B1 * 5/2001 Albert ..... B65H 59/36 242/417.3
6,945,490 B1 * 9/2005 Zollinger ..... B65H 59/22 242/153
7,243,872 B2 * 7/2007 Peeters ..... D03D 47/34 242/154
2002/0060265 A1 * 5/2002 Watson ..... B65H 55/04 242/470
2008/0092510 A1 * 4/2008 Hsu ..... B65H 59/36 57/58.83
2011/0114781 A1 * 5/2011 Kimura ..... H01F 41/064 242/443
2013/0146410 A1 * 6/2013 Thomas ..... B65H 75/44 242/153
2015/0021425 A1 * 1/2015 Yamaguchi ..... B65H 59/387 242/419
2016/0122153 A1 * 5/2016 Bewley, Jr. ..... B65H 59/36 242/421.7
2016/0339650 A1 * 11/2016 Ueda ..... B29C 70/865
2018/0236735 A1 * 8/2018 Nishibu ..... B29C 53/8041
2018/0297808 A1 * 10/2018 Lohia ..... B65H 54/02
2020/0280181 A1 * 9/2020 Tarasinski ..... B60L 9/00
2021/0388544 A1 * 12/2021 Josefsson ..... D03D 47/345
2022/0340392 A1 * 10/2022 Sato ..... H01F 41/074
2022/0396452 A1 * 12/2022 Fujiki ..... B65H 59/26
2024/0051063 A1 * 2/2024 Ichinose ..... B23K 20/26
2025/0033922 A1 * 1/2025 Lee ..... H01M 10/0404

FOREIGN PATENT DOCUMENTS

CN 209052204 U 7/2019
CN 209065198 U 7/2019
CN 209383183 U 9/2019
CN 210735838 U 6/2020
CN 212051823 U 12/2020
EP 2617670 A2 * 7/2013 ..... B21C 47/02
KR 20120038182 A * 4/2012 ..... B65H 59/10
KR 101374804 B1 * 3/2014 ..... B65H 57/06
WO WO-0117887 A1 * 3/2001 ..... B65H 59/36
WO 2019117525 A1 6/2019
WO WO-2021148922 A1 * 7/2021 ..... B65H 59/36

OTHER PUBLICATIONS

International Search Report of PCT/CN2021/075768, Oct. 11, 2021.

* cited by examiner

RIGID-FLEXIBLE COUPLING MECHANISM WITH VARIABLE ROD LENGTH FOR FIBRE BUNDLE TENSION CONTROL

CROSS-REFERENCE TO RELATED PATENT APPLICATION

This application is a continuation application of International Patent Application No. PCT/CN2021/075768, filed on Feb. 7, 2021, which itself claims priority to Chinese Patent Application No. CN202110088240.1 filed in China on Jan. 22, 2021. The disclosures of the above applications are incorporated herein in their entireties by reference.

FIELD OF THE INVENTION

The invention relates to a tension control mechanism for fibre bundle transmission processes. In specific, it is a rigid-flexible coupling mechanism with variable rod length for fibre bundle tension control.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

During the transmitting process of fibre bundles, tension fluctuation is one of the most important influences that can cause wear, pilling, breakage and even reduce the quality of the structured product. Since the fibre bundles usually undergo a complex transfer process with long path and multiple rollers from feeding to shaping which causes apparent tension fluctuations, how to achieve precise control of fibre bundle tension and improve product quality has become one of the important research directions.

At present, most common structure of fibre bundle tension control mechanism uses dance roller or swing rod. The tension regulating roller of these structures can only do linear movement or circular oscillation in a certain direction, and the driving mode generally adopts a single drive of motor or cylinder to adjust the position of the roller to achieve the tension control.

The existing single degree of freedom or fixed rod length structure of the fibre bundle tension control mechanism is limited by its space position and structure. The movement trajectory of the regulating roller is restricted, the tension control range is small, and the single rod structure is unstable, which cause the hardness of precise tension control. Meanwhile, pure rigid structure has higher stiffness, the accuracy of tension control may be affected by the inertia effect of structure movement and insufficient. Moreover, the fibre bundles constant tension and low wear transmission are limited, which has a lower reliability.

SUMMARY OF THE INVENTION

In order to solve the above-mentioned problem of tension control mechanism for fibre bundle transmission, the invention proposes a rigid-flexible coupling mechanism with variable rod length for fibre bundle tension control, which uses a combination of a servo motor and an electric actuator in a dual drive control mode. By changing the length and angle of the tension regulating rod, a four-rod fixed length mechanism or a five-rod variable length mechanism can be selected according to the size of tension fluctuations and the control range. The position of the tension regulating roller is adjusted to further regulate the fibre bundle tension which realizes a constant tension transmission.

The invention for fibre bundle tension control of rigid-flexible coupling mechanism with variable rod length, comprising a front guide roller, a back guide roller and a tension regulating roller provided between them.

The tension regulating roller is mounted on an up-and-down movable bracket on the swing frame, the swinging of the swing frame and the sliding of the tension regulating roller are controlled by a servo motor and an electric actuator in a dual drive mode, where an end of a main body of the electric actuator is connected to the servo motor, and the rod of the electric actuator is connected to one side of the bracket by a rotating shaft.

The invention for fibre bundle tension control of rigid-flexible coupling mechanism with variable rod length, which can achieve fast response to tension regulation or arbitrary trajectory adjustment of the tension regulating rollers by choosing either a four-rod fixed length or a five-rod variable length mechanism based on different working conditions.

When a tension control range is small and the fast response to the tension regulation is required, the four-rod fixed length mechanism is used for tension control. When the tension increases, an output shaft of the servo motor rotates clockwise to drive the electric actuator to rotate clockwise around a motor axis of the servo motor, and an angle of the rod of the electric actuator changes to drive the swing frame to rotate clockwise around a spindle. Meanwhile, the bracket drives the tension regulating roller to move downwards, such that distances between the tension regulating roller and the front guide roller and between the tension regulating roller and the back guide roller are reduced to achieve tension reduction. Conversely, when the tension decreases during a transmission process of the fibre bundle, the servo motor reverses to drive the swing frame to rotate counterclockwise, the tension regulating roller moves upwards, and the distances between the tension regulating roller and the front guide roller and between the tension regulating roller and the back guide roller are increased to increase the tension of the fibre bundle.

When the tension control range is large and a change in a position of the tension regulating roller is required to be along any trajectory, the five-rod variable length mechanism is used for the tension control. When the tension increases, the output shaft of the servo motor rotates clockwise to drive the electric actuator to rotate clockwise around the motor axis, and the electric actuator drives the rod thereof to contract, and the angle and a length of the rod change to drive the swing frame to rotate counterclockwise around the spindle. Meanwhile, the bracket drives the tension regulating roller to move downwards, such that the distances between the tension regulating roller and the front guide roller and between the tension regulating roller and the back guide roller are reduced to achieve tension reduction. Conversely, when the tension decreases during the transmission process of the fibre bundle, the servo motor reverses and the rod is extended to drive the swing frame to rotate clockwise, the tension regulating roller moves upwards, and the distances between the tension regulating roller and the front guide roller and between the tension regulating roller and the back guide roller are increased to increase the tension of the fibre bundle

The Advantages of the Invention

1. The invention for fibre bundle tension control of rigid-flexible coupling mechanism with variable rod length, can choose to use either a four-rod fixed length or five-rod variable length tension control mechanism according to different working conditions (tension fluctuation size, control range, etc.), which is a more flexible control method.

2. The invention for fibre bundle tension control of rigid-flexible coupling mechanism with variable rod length, is a four-rod fixed length mechanism when using the servo motor to single drive four-rod fixed length tension control mechanism. It has simple control mode and fast response time, also the control mechanism can achieve a rapid tension regulation.

3. The invention for fibre bundle tension control of rigid-flexible coupling mechanism with variable rod length, is a five-rod variable length mechanism when using the servo motor and electric actuator to dual drive five-rod variable length tension control mechanism. The tension regulating roller has wider movement trajectory range which avoid a large structure size of traditional dance roller or swing rod to achieve a wide range of tension control. Moreover, the space structure is more compact, the control mechanism can realize an accurate tension regulation.

4. The invention for fibre bundle tension control of rigid-flexible coupling mechanism with variable rod length, has a stable triangular structure formed by the tension regulating rod, pendulum, and the base during tension control process. Which improves the instability of the traditional single rod structure and the tension control accuracy.

5. The invention for fibre bundle tension control of rigid-flexible coupling mechanism with variable rod length, combines flexible springs and rigid rod control mechanism. The springs are compressed or extended during tension regulation, plays a roll as a buffer, reduces the mechanism movement inertia effect on the position of tension regulating roller, and increases the stability of regulating system.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION OF EMBODIMENTS

Figure 1:
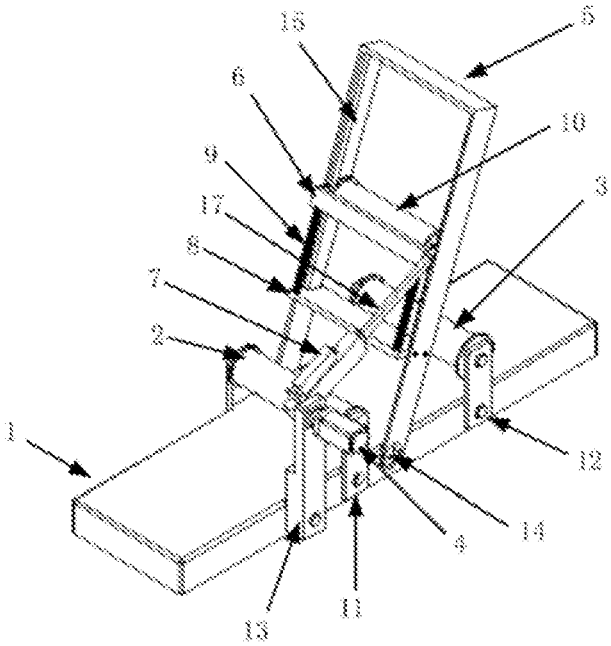
FIG. 1 shows a 3D schematic illustration of a rigid-flexible coupling mechanism with variable rod length for fibre bundle tension control.

The present disclosure will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top", and "left" and "right", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper", depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The following detailed description describes in detail the characteristics and advantages of the instant disclosure, whose content is sufficient to enable any person skilled in the relevant art to understand the technical content of the instant disclosure and implement accordingly, and according to the content, the claims and figures disclosed by the present specification, any person skilled in the relevant art can easily understand the purpose and advantages of the instant disclosure. The following embodiments further illustrate the aspects of the instant disclosure, but do not limit the scope of the instant disclosure with any aspects.

Embodiments of the present invention will now be described with reference to the drawings.

Figure 2:
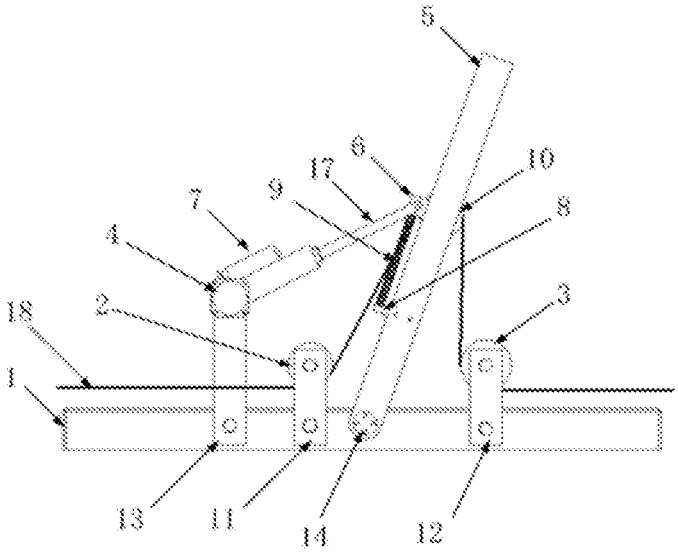
FIG. 2 shows a front schematic illustration of a rigid-flexible coupling mechanism with variable rod length for fibre bundle tension control.

The invention for fibre bundle tension control of rigid-flexible coupling mechanism with variable rod length, comprising base 1, front guide roller 2, back guide roller 3, servo motor 4, swing frame 5, bracket 6, electric actuator 7, spring substrate 8, springs 9 and tension regulating roller 10, as shown in FIGS. 1 and 2.

The base 1 is designed as a rectangular cross-sectional platform, the front guide roller 2 and the back guide roller 3 are equipped at the front and back of the base 1 middle respectively through the front guide roller substrate 11 and the rear guide roller substrate 12. The bottom of the front guide roller substrate 11 is bolted to the left and right sides of the base 1, and the top is fixed with both ends of the front guide shaft, on which the front guide roller 2 is coaxially mounted by bearings. Similarly, the bottom of the back guide roller substrate 12 is bolted to the left and right sides of the base 1, and the top is fixed with both ends of the back guide shaft, on which the back guide roller 3 is coaxially mounted by bearings.

The servo motor 4 is mounted in front of the front guide roller 2 through a motor mounting substrate 13, the bottom of the motor mounting substrate 13 is bolted to one side of the base 1 and the top is fixed with the servo motor 4. Moreover, the output shaft of the servo motor 4 is set axially along the left and right direction.

The swing frame 5 has a left pendulum, a right pendulum and a top beam, and the top of the left and right pendulums are connected to both ends of the top beam, which forms an integrated U-shaped frame. The bottoms of the left and right pendulums are mounted on the base 1 through swing frame spindle 14, positioned between the front 2 and back guide rollers 3, so that the swing frame 5 can swing around the swing frame spindle 14 in a fixed position with variable angles. The above-mentioned left and right pendulums are fitted with guide rails 15 along their respective axes on opposite sides for mounting the bracket 6.

Figure 3:
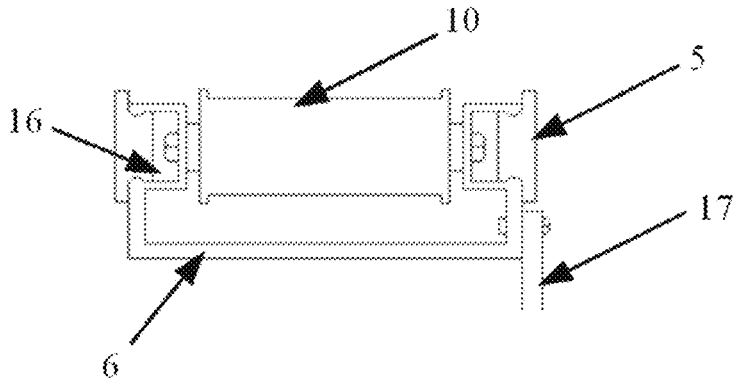
FIG. 3 shows a section schematic illustration of the tension regulating roller of a rigid-flexible coupling mechanism with variable rod length for fibre bundle tension control.

The bracket 6 is a U-shaped frame with recesses 16 on the left and right outside walls, which are slidingly connected with the guide rails 15 on the left and right pendulums respectively, so that the bracket 6 can slide along the guide rails 15. Moreover, there is a distance between the ground of the recesses 16 and the guide rails 15 for setting the tension regulating roller 10, as shown in FIG. 3. The tension regulating roller 10 is mounted on the regulating roller shaft through bearings. Both ends of the regulating roller shaft are fixed to both sides of the bracket 6 through bolts and positioned at the bottom of the recesses 16 on both sides of the bracket 6, so that the tension regulating roller 10 can move up and down with the bracket 6 together along the guide rail 15.

Both sides of the spring substrate 8 is bolted to the left and right pendulums on the swing frame 5 and positioned below the guide rail 15. The upper surface of the spring substrate 8 is bolted to the bottom of two springs 9, which are set along the left and right pendulums respectively, and the top is bolted to the bracket. When the tension regulating roller 10 and the bracket 6 reciprocally moving along the guide rail 15 on the swing frame 5, the usage of the springs 9 can eliminate the effect of inertia which cannot be solved by purely rigid structures and provide a cushioning effect on the up and down movement of the tension regulating roller 10. By using a double spring 9 connection in the invention, it is possible to avoid the unbalanced forces and torque of the bracket 6 caused by a single spring 9 extending or compressing, which further affects the accuracy of tension regulation.

The axis of electric actuator 7 is set perpendicular to the output shaft of the servo motor 4. The end of the electric actuator 7 main body is connected to the output shaft of the servo motor 4 via a coupling. The rod part of the electric actuator 7 acts as the tension regulating rod 17, and the output end of that is connected to the bottom side of the bracket 6 via a rotating shaft to achieve that the regulating rod can rotate around the rotating shaft on one side of the bracket 6 in a fixed position with variable angles. Therefore, the angle of the tension regulating rod 17 can be adjusted by the rotation of the electric actuator 7 along the servo motor 4 axis, which is driven by the rotation of the servo motor 4. The length of the tension regulating rod 17 can be adjusted by telescoping along the direction of electric actuator 7 axis, which is controlled by the electric actuator 7.

With the aforementioned design of a rigid-flexible coupling mechanism with variable rod length for fibre bundle tension control, the fibre bundle 18 is transmitted from the bottom of the front guide roller 2 to the top of the tension regulating roller 10 and then to the next mechanism via the bottom of the back guide roller 3, which shows that the position of the tension regulating roller 10 determines the tension during the transmission of the fibre bundle 18. Therefore, during the fibre transmitting process, the up, down, back, and forth position of tension regulating rollers 10 can be adjusted respectively through the motor and the electric actuator 7, and the fibre tension control can be achieved by adjusting the relative positions between the three rollers (front guide roller 2, tension regulating roller 10 and back guide roller 3). Moreover, the stability of the tension regulating mechanism during the fibre bundles 18 transmission is ensured because of a triangular structure formed by the swing frame 5, the tension regulating rod 17 and the base 1. Which can also avoid the tension fluctuations caused by the structure instability and improve the tension regulation accuracy. The surface of the front guide roller 2, the tension regulating roller 10 and the back guide roller 3 can also be designed with a concave structure to act as an axial limit for fibre bundles 18, which can avoid tension fluctuations caused by fibre swinging during the transmitting process.

The invention for fibre bundle tension control of rigid-flexible coupling mechanism with variable rod length, when regulating the tension can choose four-rod fixed length or five-rod variable length mechanism according to different working conditions. Also, it can achieve a fast tension regulating response or arbitrary adjust the tension regulating roller 10 trajectory and increase the tension regulation range to meet different tension regulation requirements, with flexible and reliable methods.

Figure 4:
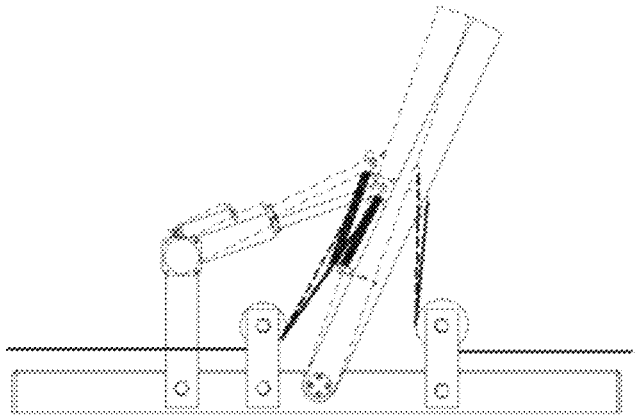
FIG. 4 shows a schematic illustration of a rigid-flexible coupling mechanism with variable rod length for fibre bundle tension control when using four-rod fixed length mechanism to regulate the tension.

When the tension control range is small and a fast response to tension control is required, a four-rod fixed length tension control mechanism is used to regulate the tension, as shown in FIG. 4. Specifically, the four-rod fixed length tension control mechanism as shown in FIG. 4 is formed by the electric actuator 7, the bracket 6 and the tension regulating roller 10 mounted thereon, the swing frame 5 and the base 1, in which the tension regulating rod 17 of the electric actuator 7 is controlled to be fixed (i.e., without contracting or extending) to the main body of the electric actuator 7, resulting in the fixed length of the electric actuator 7. The fibre bundles 18 is transmitted to the tension regulating roller 10 via the front guide roller 2 and then to the next mechanism through the back guide roller 3. The fibre bundle 18 is wound counterclockwise, clockwise and counterclockwise at the front guide roller 2, the tension regulating roller 10 and the back guide roller 3 respectively, and the position of the front 2 and back guide rollers 3 is fixed, the tension of the fibre bundle 18 is regulated by controlling the position of the tension regulating roller 10. The initial positions and states of the swing frame 5, the tension regulating roller 10, the tension regulating rod 17 and the electric actuator 7 during the transmission of the fibre bundle 18 are shown in the dashed part of FIG. 4. When tension becomes large, the controller outputs a control signal, and the mechanism completes the following active actions. The output shaft of servo motor 4 rotates clockwise, driving electric actuator 7 to rotate clockwise around the axis of servo motor 4. Due to the angle change of tension regulating rod 17, swing frame 5 is driven to rotate clockwise around the spindle. Meanwhile, bracket 6 drives tension regulating roller 10 moves along guide rail 15 in the direction close to swing frame spindle 14, the spring 9 is compressed which makes the distance between the tension regulating roller 10 and the front guide roller 2 and the back guide roller 3 decreasing, as shown in the solid part in FIG. 4. Thus, reducing the tension and achieving the tension regulation of the fibre bundle 18. Conversely, when the tension of the fibre bundle 18 decreases during transmission, the servo motor 4 reverses and drives the swing frame 5 to rotate counterclockwise, the tension regulating roller 10 moves away from the swing frame spindle 14, the spring 9 is stretched and the distance between the front guide roller 2 and the back guide roller 3 increases to achieve an increase in the tension of the fibre bundle 18. Thus, the four-rod fixed length tension control mechanism is controlled solely by the servo motor 4. As the four-rod tension control mechanism is only driven by a single motor at this point, the tension control response is fast and can achieve rapid tension regulation.

Figure 5:
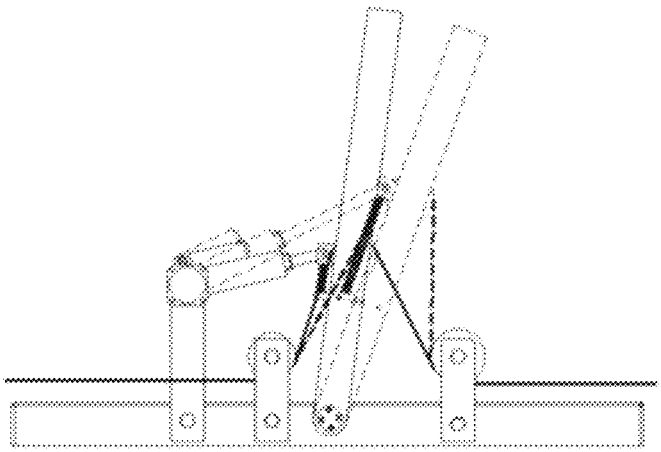
FIG. 5 shows a schematic illustration of a rigid-flexible coupling mechanism with variable rod length for fibre bundle tension control when using five-rod variable length mechanism to regulate the tension.

When the tension control range is large and the position change of the tension regulating roller 10 is required along an arbitrary trajectory, a five-rod variable length tension control mechanism is used to regulate the tension, as shown in FIG. 5. Specifically, the five-rod variable length tension control mechanism as shown in FIG. 5 is formed by the main body of the electric actuator 7, the tension regulating rod 17 of the electric actuator 7, the bracket 6 and the tension regulating roller 10 mounted thereon, the swing frame 5 and the base 1, in which the tension regulating rod 17 of the electric actuator 7 is controlled to be contractable and extendable (i.e., not fixed) relative to the main body of the electric actuator 7, resulting in the variable length of the tension regulating rod 17 from the main body of the electric actuator 7. The initial position and state of the front guide roller 2, tension regulating roller 10, tension regulating rod 17 and electric actuator 7 during the transmission of fibre bundle 18 are shown in the dashed part of FIG. 5. When tension becomes large, the controller outputs a control signal, and the mechanism completes the following active actions. The output shaft of servo motor 4 rotates clockwise, driving electric actuator 7 to rotate clockwise around the axis of servo motor 4. The electric actuator 7 drives the tension regulating rod 17 to contract at the same time. Due to the angle and length change of tension regulating rod 17, swing frame 5 is driven to rotate counterclockwise around the spindle. Meanwhile, bracket 6 drives tension regulating roller 10 moves along guide rail 15 in the direction close to swing frame spindle 14, the spring 9 is compressed which makes the distance between the tension regulating roller 10 and the front guide roller 2 and the back guide roller 3 decreasing, as shown in the solid part in FIG. 5. Thus, reducing the tension and achieving the tension regulation of the fibre bundle 18. Thus, the five-rod variable length tension control mechanism is controlled by both the servo motor 4 and the electric actuator 7.

Conversely, when the tension of the fibre bundle 18 decreases during transmission, the servo motor 4 reverses, the tension regulating rod 17 stretches and drives the swing frame 5 to rotate clockwise, the tension regulating roller 10 moves away from the swing frame spindle 14, and the distance between the front guide roller 2 and the back guide roller 3 increases to achieve an increase in the tension of the fibre bundle 18. During the tension regulating roller 10 reciprocally moving along the guide 15, the spring 9 between the bracket 6 and the spring substrate 8 is compressed or stretched, providing a cushioning effect for the movement of the mechanism, avoiding the vibration caused by the movement of the rigid structure which can affect the accuracy and achieving a stable and precise tension regulation by the rigid-flexible coupling mechanism.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A rigid-flexible coupling mechanism for fibre bundle tension control, comprising a front guide roller, a back guide roller, and a tension regulating roller provided between the front guide roller and the back guide roller, wherein the tension regulating roller is mounted on an up-and-down movable bracket on a swing frame, the swing frame is rotatably disposed on a base, swinging of the swing frame relative to the base and sliding of the tension regulating roller are controlled by a servo motor and an electric actuator in a dual drive mode, wherein an end of a main body of the electric actuator is connected to an output shaft of the servo motor, the servo motor is fixed to the base, and a rod of the electric actuator is connected to one side of the bracket by a rotating shaft;

wherein two sliding rails are mounted on two sides of the swing frame to be connected with the bracket through a sliding connection, and the tension regulating roller is mounted on the bracket, facilitating up-and-down sliding of the tension regulating roller; a spring substrate is mounted on the swing frame below the tension regulating roller, and the spring substrate is connected to the tension regulating roller through springs to provide a cushioning effect on an up-and-down movement of the tension regulating roller;

wherein when the rod of the electric actuator is controlled to be fixed to the main body of the electric actuator, the electric actuator, the bracket and the tension regulating roller mounted thereon, the swing frame and the base collectively form a four-rod fixed length mechanism for the fibre bundle tension control, and the four-rod fixed length mechanism is controlled solely by the servo motor; wherein in an operation of the four-rod fixed length mechanism, when the tension increases, the output shaft of the servo motor rotates clockwise to drive the electric actuator to rotate clockwise around a motor axis of the servo motor, and an angle of the rod of the electric actuator changes to drive the swing frame to rotate clockwise around a spindle meanwhile, the bracket drives the tension regulating roller to move downwards, such that distances between the tension regulating roller and the front guide roller and between the tension regulating roller and the back guide roller are reduced to achieve tension reduction; conversely, when the tension decreases during a transmission process of the fibre bundle, the servo motor reverses to drive the swing frame to rotate counterclockwise, the tension regulating roller moves upwards, and the distances between the tension regulating roller and the front guide roller and between the tension regulating roller and the back guide roller are increased to increase the tension of the fibre bundle;

wherein when the rod of the electric actuator is controlled to be contractable and extendable relative to the main body of the electric actuator, the main body of the electric actuator, the rod of the electric actuator, the bracket and the tension regulating roller mounted thereon, the swing frame and the base collectively form a five-rod variable length mechanism for the fibre bundle tension control, and the five-rod variable length mechanism is controlled by both the servo motor and the electric actuator; wherein in an operation of the five-rod variable length mechanism, when the tension increases, the output shaft of the servo motor rotates clockwise to drive the electric actuator to rotate clockwise around the motor axis, and the electric actuator drives the rod thereof to contract, and the angle of the rod of the electric actuator and a length of the rod relative to the main body of the electric actuator change to drive the swing frame to rotate counterclockwise around the spindle, meanwhile, the bracket drives the tension regulating roller to move downwards, such that the distances between the tension regulating roller and the front guide roller and between the tension regulating roller and the back guide roller are reduced to achieve tension reduction; conversely, when the tension decreases during the transmission process of the fibre bundle, the servo motor reverses and the rod is extended to drive the swing frame to rotate clockwise, the tension regulating roller moves upwards, and the distances between the tension regulating roller and the front guide roller and between the tension regulating roller and the back guide roller are increased to increase the tension of the fibre bundle.

2. The rigid-flexible coupling mechanism for fibre bundle tension control as claimed in claim 1, wherein the spring substrate is connected to the tension regulating roller through two springs, and each of the two springs is located adjacent to one of the two sides of the swing frame.

* * * * *